US006464654B1

(12) United States Patent
Montgomery et al.

(10) Patent No.: US 6,464,654 B1
(45) Date of Patent: Oct. 15, 2002

(54) MASSAGING SHOE DEVICE

(76) Inventors: Julia S. Montgomery, 36 Edward Street, Kamloops, BC (CA), V2B 4G1; Sharleen M. Warner, 36 Edward Street, Kamloops, BC (CA), V2B 4G1

( * ) Notice: Subject to any disclaimer, the term of this patent is extended or adjusted under 35 U.S.C. 154(b) by 0 days.

(21) Appl. No.: 09/765,662

(22) Filed: Jan. 22, 2001

(51) Int. Cl.[7] ..... A61H 5/00

(52) U.S. Cl. ..... 601/46; 601/1; 601/27; 601/28

(58) Field of Search ..... 601/1, 22, 27, 601/28, 46, 104; 434/236

(56) References Cited

U.S. PATENT DOCUMENTS 4,802,463 A 2/1989 Rojas
5,113,850 A 5/1992 Larremore et al.
5,592,759 A 1/1997 Cox
5,836,899 A 11/1998 Reilly
D410,962 S 6/1999 Iwahashi
5,913,838 A 6/1999 Reilly
6,024,575 A * 2/2000 Ulrich ..... 434/236

* cited by examiner

*Primary Examiner*—Glenn E. Richman

(57) ABSTRACT

A massaging shoe device for providing vibrating massage to the bottom portion of a wearer's foot. The massaging shoe device includes a sole having a cavity positioned therein. A vibrator is positioned in the cavity. A power supply for powering the vibrator is electrically coupled to the vibrator. An actuator for selectively turning the vibrator on and off is electrically coupled to the vibrator. A perimeter wall is integrally coupled to a perimeter edge of the sole and extends upwardly therefrom for substantially covering a foot of a user.

5 Claims, 3 Drawing Sheets

MASSAGING SHOE DEVICE

BACKGROUND OF THE INVENTION

1. Field of the Invention

The present invention relates to massaging shoe devices and more particularly pertains to a new massaging shoe device for providing vibrating massage to the bottom portion of a wearer's foot.

2. Description of the Prior Art

The use of massaging shoe devices is known in the prior art. More specifically, massaging shoe devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,113,850; U.S. Pat. No. 5,836,899; U.S. Pat. No. 5,592,759; U.S. Pat. No. 5,913,838; U.S. Pat. No. 4,802,463; and U.S. Des. Pat. No. 410,962.

While these devices fulfill their respective, particular objectives and requirements, the aforementioned patents do not disclose a new massaging shoe device. The inventive device includes a sole having a cavity positioned therein. A vibrator is positioned in the cavity. A power supply for powering the vibrator is electrically coupled to the vibrator. An actuator for selectively turning the vibrator on and off is electrically coupled to the vibrator. A perimeter wall is integrally coupled to a perimeter edge of the sole and extends upwardly therefrom for substantially covering a foot of a user.

In these respects, the massaging shoe device according to the present invention substantially departs from the conventional concepts and designs of the prior art, and in so doing provides an apparatus primarily developed for the purpose of providing vibrating massage to the bottom portion of a wearer's foot.

SUMMARY OF THE INVENTION

In view of the foregoing disadvantages inherent in the known types of massaging shoe devices now present in the prior art, the present invention provides a new massaging shoe device construction wherein the same can be utilized for providing vibrating massage to the bottom portion of a wearer's foot.

The general purpose of the present invention, which will be described subsequently in greater detail, is to provide a new massaging shoe device apparatus and method which has many of the advantages of the massaging shoe devices mentioned heretofore and many novel features that result in a new massaging shoe device which is not anticipated, rendered obvious, suggested, or even implied by any of the prior art massaging shoe devices, either alone or in any combination thereof.

To attain this, the present invention generally comprises a sole having a cavity positioned therein. A vibrator is positioned in the cavity. A power supply for powering the vibrator is electrically coupled to the vibrator. An actuator for selectively turning the vibrator on and off is electrically coupled to the vibrator. A perimeter wall is integrally coupled to a perimeter edge of the sole and extends upwardly therefrom for substantially covering a foot of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new massaging shoe device apparatus and method which has many of the advantages of the massaging shoe devices mentioned heretofore and many novel features that result in a new massaging shoe device which is not anticipated, rendered obvious, suggested, or even implied by any of the prior art massaging shoe devices, either alone or in any combination thereof.

It is another object of the present invention to provide a new massaging shoe device which may be easily and efficiently manufactured and marketed.

It is a further object of the present invention to provide a new massaging shoe device which is of a durable and reliable construction.

An even further object of the present invention is to provide a new massaging shoe device which is susceptible of a low cost of manufacture with regard to both materials and labor, and which accordingly is then susceptible of low prices of sale to the consuming public, thereby making such massaging shoe device economically available to the buying public.

Still yet another object of the present invention is to provide a new massaging shoe device which provides in the apparatuses and methods of the prior art some of the advantages thereof, while simultaneously overcoming some of the disadvantages normally associated therewith.

Still another object of the present invention is to provide a new massaging shoe device for providing vibrating massage to the bottom portion of a wearer's foot.

Yet another object of the present invention is to provide a new massaging shoe device which includes a sole having a cavity positioned therein. A vibrator is positioned in the cavity. A power supply for powering the vibrator is electrically coupled to the vibrator. An actuator for selectively turning the vibrator on and off is electrically coupled to the vibrator. A perimeter wall is integrally coupled to a perimeter edge of the sole and extends upwardly therefrom for substantially covering a foot of a user.

Still yet another object of the present invention is to provide a new massaging shoe device that provides a person with direct massage to their feet while wearing shoes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
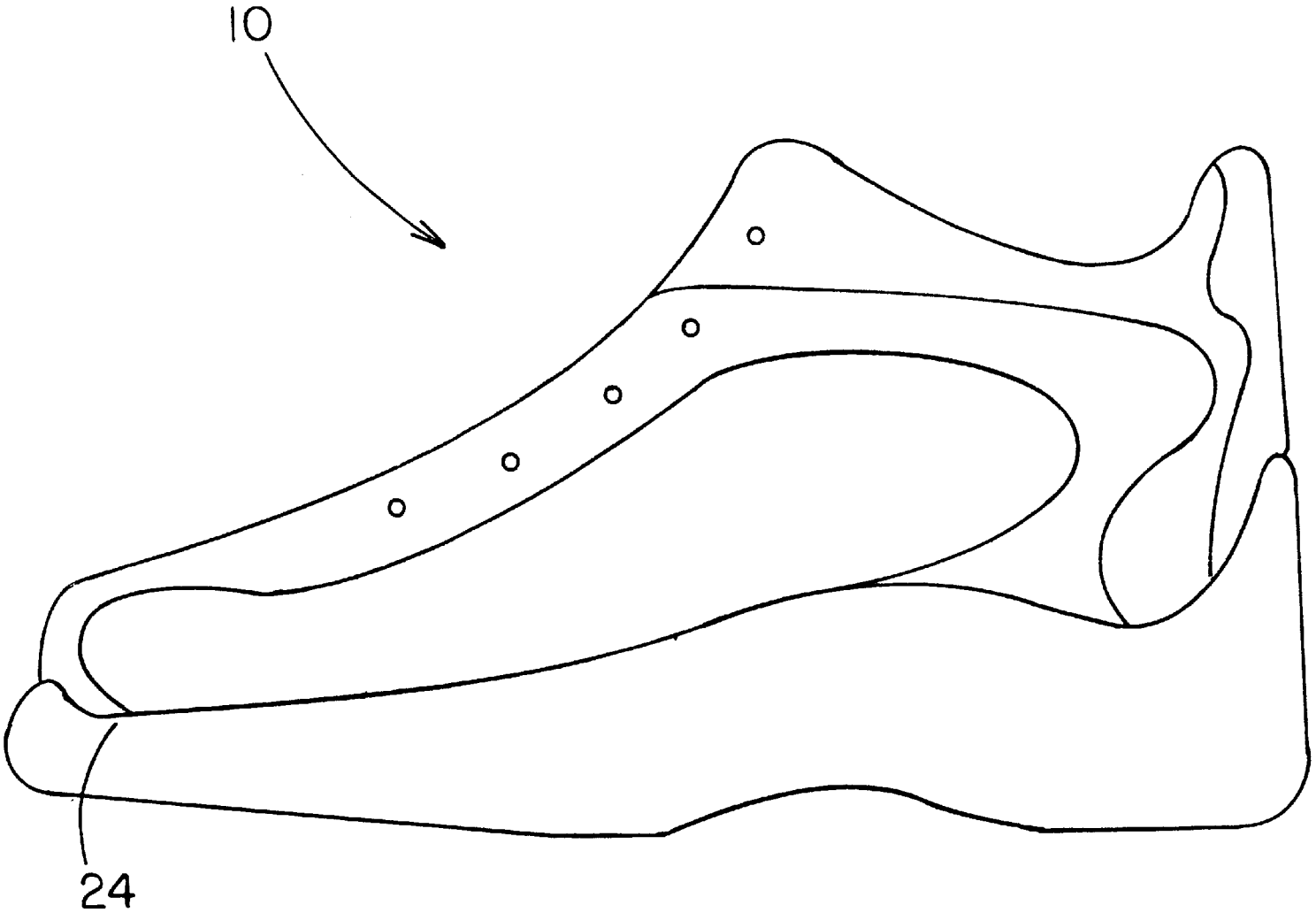
FIG. 1 is a schematic side view of a new massaging shoe device according to the present invention.
Figure 2:
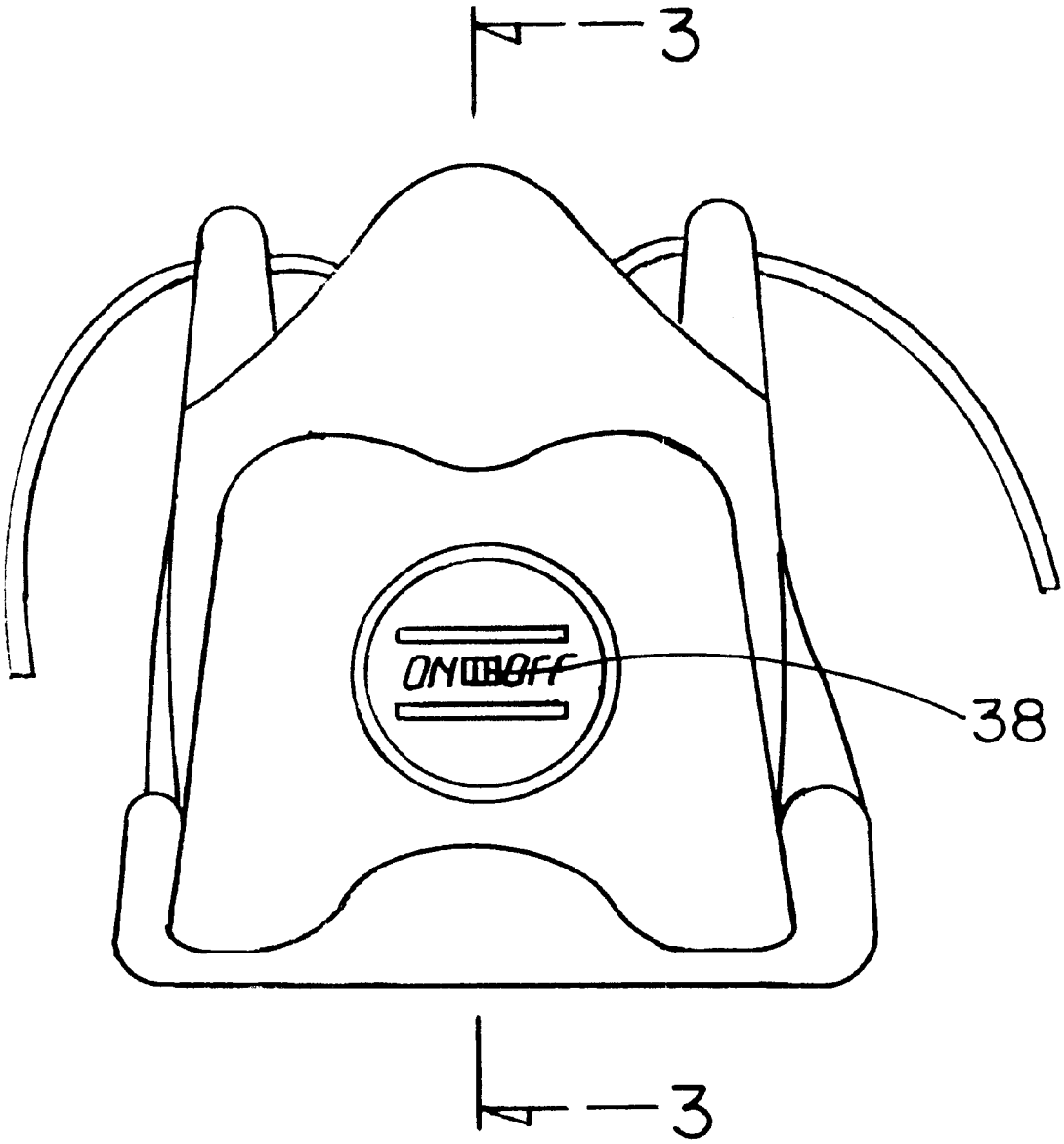
FIG. 2 is a schematic back view of the present invention.
Figure 3:
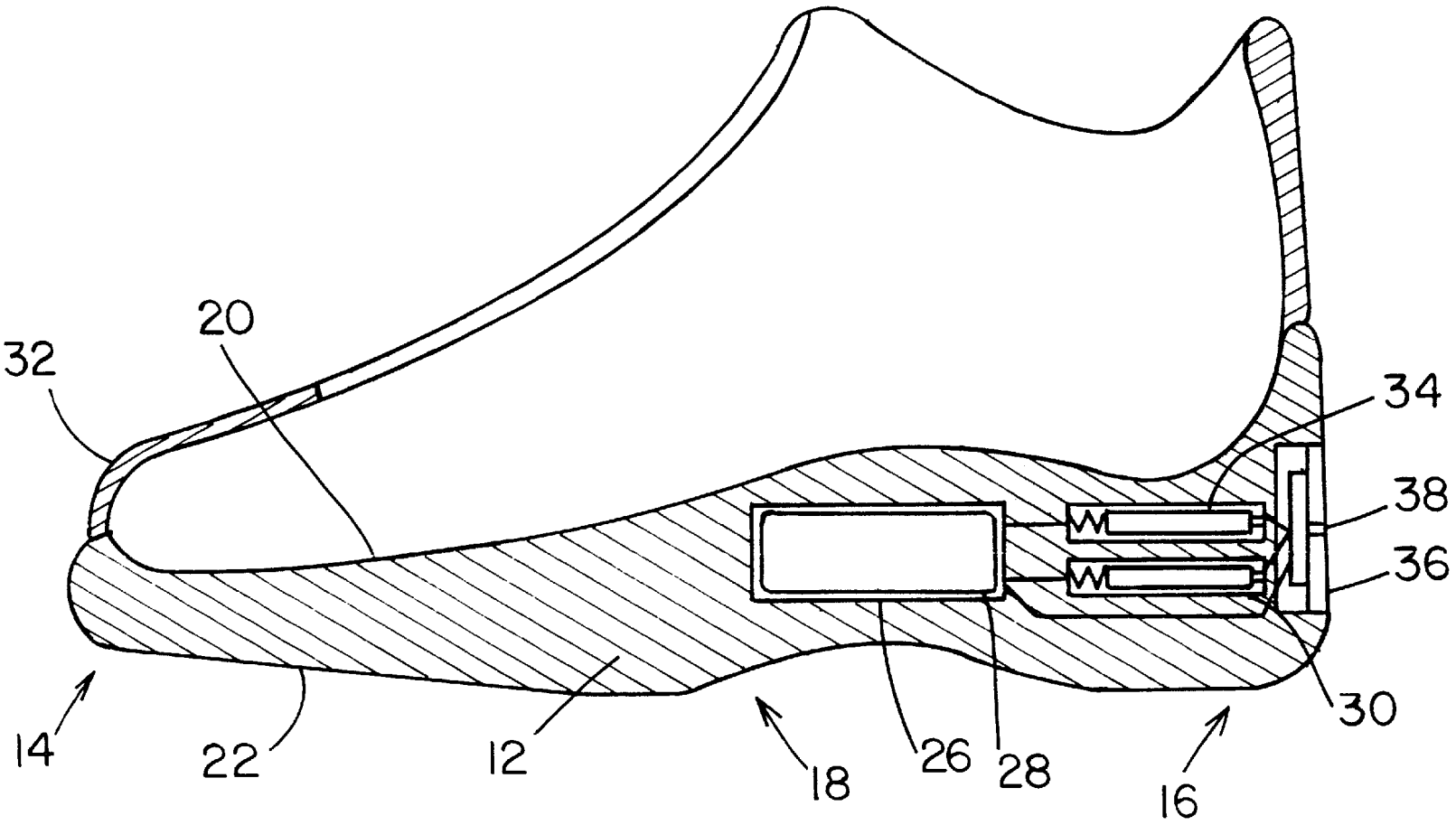
FIG. 3 is a schematic cross-sectional view taken along line 3—3 of the present invention.

With reference now to the drawings, and in particular to FIGS. 1 through 3 thereof, a new massaging shoe device embodying the principles and concepts of the present invention and generally designated by the reference numeral 10 will be described.

As best illustrated in FIGS. 1 through 3, the massaging shoe device 10 generally includes a sole 12 having a toe portion 14, a heal portion 16 and an arch portion 18 positioned between the heal 16 and toe 14 portions. The sole 12 has a top surface 20, a bottom surface 22 and a perimeter edge 24. The arch portion 18 has a cavity 26 positioned therein. The perimeter edge 24 has an opening 30 therein extending into the heal portion 16. A perimeter wall 32 is integrally coupled to the perimeter edge 24 and extends upwardly therefrom for substantially covering a foot of a user. The sole 12 and perimeter wall 24 define a conventional shoe.

A vibrator 28 is positioned in the cavity 26. The vibrator 28 is a conventional vibrator including a housing adapted for providing an oscillating motion.

A power supply 34 for powering the vibrator 28 is electrically coupled to the vibrator 28. The power supply 34 is positioned in the opening 30 and preferably comprises at least one battery.

A cover 36 for selectively closing the opening 30 is positionable in the opening 30. The cover 36 frictionally engages an inner surface of the opening 30.

An actuator 38 for selectively turning the vibrator 28 on and off is electrically coupled to the vibrator 28. The actuator 38 ideally comprises a button positioned on the cover 36.

In use, the device is worn as a conventional shoe. The wearer of the device may turn on the vibrator 28 so that the vibrator massages the bottom of their foot. This reduces pain in the feet, legs and lower back.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A massaging shoe device, said device comprising:

a sole having a cavity positioned therein, said sole having a substantially smooth top surface;

a vibrator being positioned in said cavity;

a power supply for powering said vibrator, said power supply being electrically coupled to said vibrator;

an actuator for selectively turning said vibrator on and off, said actuator being electrically coupled to said vibrator; and a perimeter wall being integrally coupled to a perimeter edge of said sole and extending upwardly therefrom for substantially covering a foot of a user.

2. The massaging shoe device as in claim 1, wherein said sole has a toe portion, a heal portion and an arch portion positioned between the heal and toe portions, said arch portion having said cavity positioned therein.

3. The massaging shoe device as in claim 2, wherein said perimeter edge has an opening therein extending into said heal portion, said power supply being positioned in said opening, said power supply comprising at least one battery.

4. The massaging shoe device as in claim 3, further including:

a cover for selectively closing said opening, said cover being positionable in said opening and frictionally engaging an inner surface of said opening.

5. A massaging shoe device, said device comprising:

a sole having a toe portion, a heal portion and an arch portion positioned between the heal and toe portions, said sole having a substantially smooth-top surface, a bottom surface and a perimeter edge, said arch portion having a cavity positioned therein, said perimeter edge having an opening therein extending into said heal portion;

a vibrator being positioned in said cavity;

a power supply for powering said vibrator, said power supply being electrically coupled to said vibrator, said power supply being positioned in said opening, said power supply comprising at least one battery;

a cover for selectively closing said opening, said cover being positionable in said opening and frictionally engaging an inner surface of said opening;

an actuator for selectively turning said vibrator on and off, said actuator being electrically coupled to said vibrator, said actuator being comprising a button positioned on said cover; and a perimeter wall being integrally coupled to said perimeter edge and extending upwardly therefrom for substantially covering a foot of a user.

* * * * *